US005185967A

United States Patent [19]

Cutsforth

[11] Patent Number: 5,185,967

[45] Date of Patent: Feb. 16, 1993

[54] APPARATUS FOR TRUING OUT OF ROUND ROTATING COMPONENTS

[76] Inventor: David L. Cutsforth, 1005 Horseshoe Lake Rd., Grand Rapids, Minn. 55744

[21] Appl. No.: 655,329

[22] Filed: Feb. 13, 1991

[51] Int. Cl.[5] ..... B24B 19/00

[52] U.S. Cl. ..... 51/289 R; 51/273; 51/156; 51/251; 51/244; 51/205 R

[58] Field of Search ..... 51/273, 211 R, 289 R, 51/204, 205 R, 149, 156, 161, 251, 255, 391, 392, 170 R, 179, 281 R, 244; 157/13

[56] References Cited

U.S. PATENT DOCUMENTS

| | | | |
|---|---|---|---|
| 2,689,437 | 7/1953 | Miller | 51/205 R |
| 2,879,530 | 3/1959 | Ego | 51/273 |
| 4,021,912 | 5/1977 | Stanfield | 157/13 |

OTHER PUBLICATIONS

*Grinding*, Norton Company, 1922, Chapter 4, p. 69.

*Primary Examiner*—Bruce M. Kisliuk
*Assistant Examiner*—Eileen P. Morgan
*Attorney, Agent, or Firm*—Jerold M. Forsberg

[57] ABSTRACT

An apparatus for truing out of round components of rotating mechanisms includes a grindstone and a weighted hand held holder for the grindstone. The holder includes a sleeve with a passageway for receiving the grindstone telescopically therein and for removal of debris created during the grinding process. The sleeve includes weights bonded thereto and a non-conductive shell encompassing the weights for protection of the user. The amount of weight added to the holder is predetermined and is coordinated to the cross-sectional area of the grindstone such that the apparatus has a predetermined amount of resistance to movement as the grindstone is used to remove high areas and imperfections from the surface of the out of round rotating component. The holder, when connected to a vacuum source, removes debris created by the grinding process by drawing the debris through the sleeve beneath the grindstone.

9 Claims, 2 Drawing Sheets

APPARATUS FOR TRUING OUT OF ROUND ROTATING COMPONENTS

BACKGROUND OF THE INVENTION

The present invention relates generally to an apparatus for turing out of round components of rotating mechanisms, and more specifically to a hand held tool holder which includes a weighted body portion with a passageway therethrough, a generally flat grindstone protruding from one end of the passageway, and provision for attachment of a vacuum source to a second end of the passageway.

An early approach to resurfacing a rotating component such as a commutator, depicted in U.S. Pat. No. 1,566,164, shows a hand held device which utilizes sand paper as an abrasive for cleaning the commutator of a generator. Another early hand held tool for resurfacing and cleaning of commutators, depicted in U.S. Pat. No. 1,763,561, also utilizes sand paper. The problem with hand held resurfacing tools such as these has been, until the advent of the instant invention, that they tend to follow the surface of the out of round component and only polish its surface without truing the component by making it concentric again.

More recently, and prior to the instant invention, devices utilizing grind stones for resurfacing and truing out of round commutators and the like required either that a portion of the piece of equipment having the out of round component be disassembled or that a complex grinder be mounted thereto. In either case, the process of resurfacing and truing of commutators and the like has been time consuming and costly. An arrangement for resurfacing a commutator with a grinder mounted thereto is depicted in U.S. Pat. No. 2,784,537. This arrangement is fixed to a stationary portion of the piece of equipment and includes a vacuum arrangement for the removal of dust produced by the grinding process. Another arrangement, depicted in U.S. Pat. No. 4,536,915, shows a complex grinder utilized for resurfacing of rotating portions of a motor in a railroad engine and includes provisions for the removal of dust as well as movement of the grinding mechanism by a parallelogramic linkage and a carriage rolling in a pit beneath the railway track on which the railroad engine is supported.

Clearly, as will become more apparent from an understanding of the instant invention, none of the prior art arrangements for resurfacing and/or truing out of round components of rotating mechanisms anticipate the instant invention as taught herein.

SUMMARY OF THE INVENTION

According to the present invention, an apparatus for truing out of round components of rotating mechanisms includes a weighted hand held tool holder for supporting a grindstone. The tool holder has a provision for the attachment of a suction source for removal of dust created by the grindstone as the out of round component is trued during the grinding process. In the preferred form, the tool holder includes a sleeve forming a passageway for the removal of the dust therethrough and for adjustably receiving the grindstone therein. The sleeve has weights for the protection of the user secured thereto and a nonconductive shell encompasses the sleeve and weights. In use, the grindstone is adjusted and secured relative to the hand held tool holder such that when the grindstone is touched to a rotating out of round component, at a predetermined angle, with a suction source attached to the tool holder, and supported by a stationary portion of the piece of equipment being worked on, the high areas causing the component to be out of round and imperfections in the surface of the rotating component are removed.

Accordingly, it is an object of the present invention to provide an apparatus for truing out of round components of rotating mechanisms by removing high areas and surface imperfections.

It is another object of this invention to provide a hand held apparatus for the removal of high areas and surface imperfections on an out of round rotating component which will resist following the surface of the out of round component as the component rotates.

It is yet another object of the present invention to provide an apparatus for truing out of round components while they are rotating by using a grindstone and to provide for the removal of dust created by the grinding process.

It is also an object of this invention to provide an apparatus which overcomes the problems in the prior art and which is efficient and economical in construction.

Other objects and advantages of the present invention will be apparent and understood from the following detailed description when taken in conjunction with the accompanying drawings.

DETAILED DESCRIPTION OF THE PREFERRED EMBODIMENT

Figure 1:
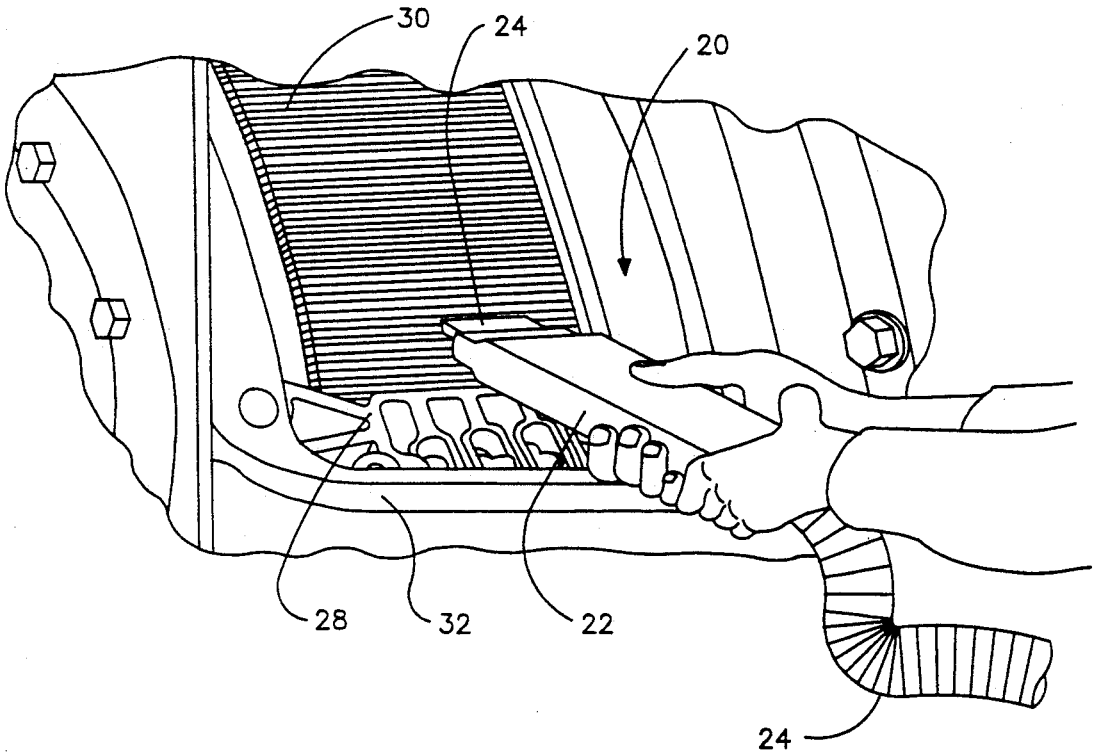
FIG. 1 is a perspective view of a hand held apparatus constructed in accordance with the instant invention, being used to true an out of round rotating commutator.

Reference herein below is made to the drawings wherein like reference numerals have been employed to designate the same or similar components throughout the various views.

Referring now to FIG. 1, an apparatus 20 for truing out of round components of rotating mechanisms includes a hand held tool holder 22 with a first end having a grindstone 24 projecting therefrom and a second end having a hose 26, which is part of a vacuum source, (not shown) connected thereto second end thereof. Apparatus 20 is shown resting on a brush holder 28, i.e., against a portion of the piece of equipment containing the out of round component, such that grindstone 24 can be lightly touched against commutator 30, i.e., part of a rotating mechanism contained within housing 32. The process will be discussed in detail later.

Figure 2:
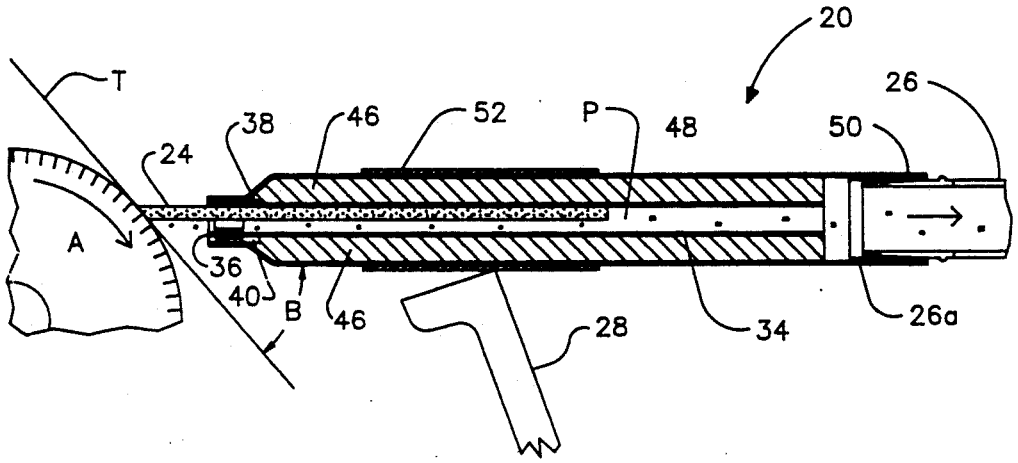
FIG. 2 is a cross sectional view of the hand held apparatus, as depicted in FIG. 1, showing the preferred orientation of the apparatus relative to a rotating component.
Figure 3:
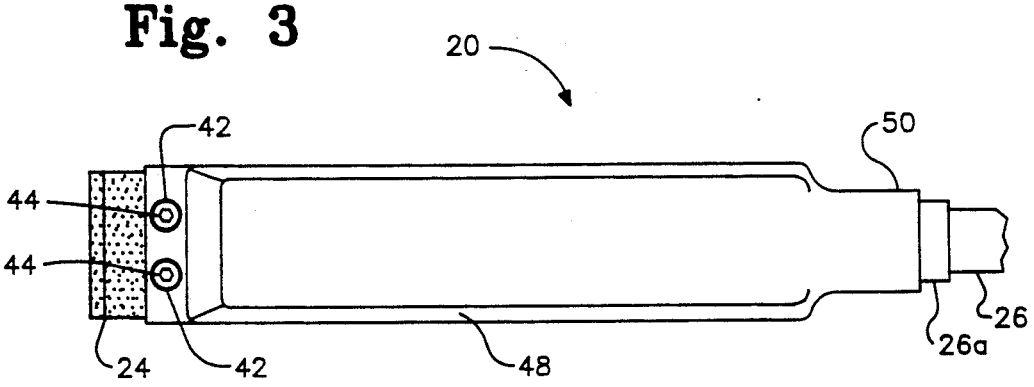
FIG. 3 is a bottom plan view of the apparatus depicted in FIG. 1.
Figure 4:
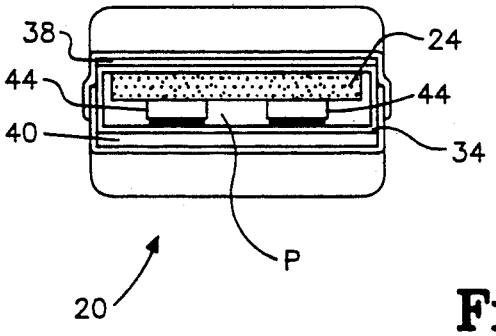
FIG. 4 is an end view of the apparatus depicted in FIG. 3 looking at the end from which the grindstone projects.
Figure 5:
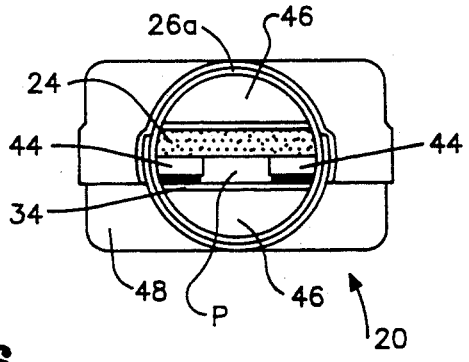
FIG. 5 is an end view of the apparatus depicted in FIG. 3 looking at the end to which the vacuum source can be connected.

Referring now to FIGS. 2 through 5, tool holder 22 includes a generally rectangular sleeve 34 with an internal passageway P. Grindstone 24 is telescopically received in passageway P and protrudes from end 36 of sleeve 34. End 36 is reinforced by welded reinforcing plates 38 and 40 and bottom reinforcing plate 40 is preferably of a thickness sufficient to have threaded bores 42 (not shown in detail) therein. Threaded bores 42 extend through the reinforcing plate 40 and the sleeve 34 and set screws 44 are utilized to secure grindstone 24 relative to the tool holder. As seen in FIGS. 3 and 4, a pair of set screws 44 are used when the grindstone is more than 2 inches in width. Rectangular sleeve 34 has weights 46 secured thereto and in the preferred form the rectangular sleeve 34 has tabs (not shown) struck outwardly and lead is molded to the sleeve in a configuration to fit snug within a nonconductive shell 48 which encompasses the sleeve 34 and weights 46. The nonconductive shell 48 is preferably vacuum formed plastic and, in the preferred form, is made in two parts with the two parts being chemically bonded to one another so as to enclosure the sleeve and weights. As best seen in FIG. 2, the nonconductive shell 48 has one end reduced to closely fit around end 36 of sleeve 34, i.e., the end with the set screws for securing the grindstone relative thereto, and a second end 50 formed to permit direct connection of hose 26 or, in the alternative, an adaptor 26 which will permit connection of hose 26 thereto. Again, as best seen in FIG. 2, a vacuum source with hose 26 draws debris, which is depicted as dust particles, through the passageway P in the rectangular sleeve, beneath the grindstone, and away from the rotating commutator in the direction of the arrow depicted in hose 26.

Figure 6:
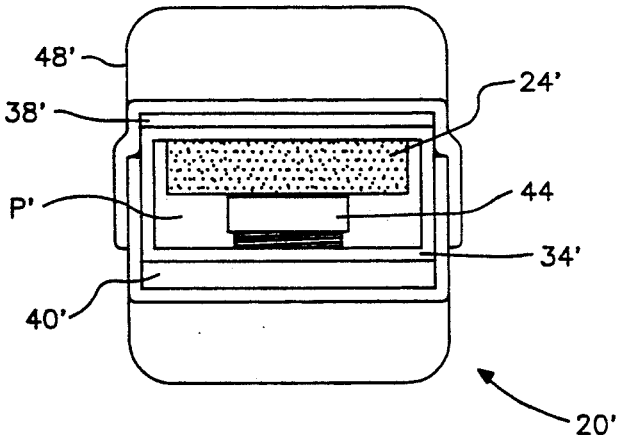
FIG. 6 is an end view, similar to FIG. 4, of a smaller embodiment of the invention.

It is contemplated that various widths of grindstones can be accommodated and it is anticipated that various sizes of tool holders will be required for particular applications. For example, a grindstone between 120 and 220 grit is preferred and when a grindstone about 0.25 inches thick and about 2.5 inches wide is used with the tool holder 22, the preferred amount of weight added to the tool holder brings the total weight of the apparatus to about 14 pounds. An apparatus 20' for a narrow grindstone 24', e.g., a grindstone about 1.25 inches wide, as depicted in FIG. 6, includes a single set screw for securing the grindstone relative to the tool holder and, in its preferred form, has a total weight of about 7 pounds. The significance of the weight ratio to the size of the stone will be discussed later. However, because of the weight of the apparatus and the manner in which the apparatus is used, it is preferable for the tool holder to include either a wide rubber band 52 therearound or a pad which will preclude damage to the tool holder when it is supported by a piece of equipment in which the out of round component is contained.

In use, the grindstone is adjusted to protrude about 1.25 inches from the tool holder, a vacuum source is connected to the tool holder, the tool holder is rested on a portion of the piece of equipment and the grindstone is lightly touched to the rotating component at approximately 45 degrees relative to the tangent for the rotating component with the grindstone pointing generally in a direction opposite to the direction of rotation of the rotating component. The grindstone is then slowly moved back and forth relative to the surface of the rotating component until the high areas and surface imperfections have been removed. As shown in FIG. 2, the rotating component is rotating in the direction of arrow A with the tool holder being held at generally 45 degrees "angle B" and the tool holder resting on a portion of case 28 within which the rotating component is contained. It should be readily apparent that angle B also refers to the angle between the grindstone 24 and tangent T at the point of contact of the grindstone with the rotating component.

Tool holders with grindstone sizes and added weight, as discussed above and disclosed herein, have approximately 25 pounds per square inch of resistance to movement at the cutting surface. This is not 25 pounds of force against the rotating component but in fact is the resistance to movement by the tool holder, i.e., the surface area of the end of the grindstone engaging the out of round component divided into the weight of the apparatus. As a high area on the rotating component is engaged by the grindstone it will take about 25 pounds per square inch of force to make the stone and tool holder move. The result being that, when the tool holder is held steady and gently touched to an out of round rotating component, a high area on the rotating component is progressively ground away. It should be apparent that if there is a low area, the stone, because of its weight and the fact that it is resting on a stationary support, will not follow the low area i.e., move toward the out of round component and remove additional material therefrom and thereby cause the rotating component to continue to be out round. It has been found that if the grindstone is adjusted to extend approximately 1.5 inches from the end of the tool holder (1.25 inches is very effective) that most of the dust created by the grinding process will be drawn from the area by the vacuum source. As best seen in FIG. 2, the dust is drawn from beneath the stone into the passageway in the rectangular sleeve through the sleeve into the hose, and into the dust bin of the vacuum source. The use of fine grit grindstones and a weighted tool holder, along with the grindstone being touched lightly to the rotating component, results in a truing of the rotating component thereby renewing its efficiency and maximizing its life expectancy.

While this invention has been described with a certain degree of particularity it is manifest that many changes may be made in the details of construction and in the arrangement of the components without departing from the spirit and scope of the disclosure. It is understood that the invention is not limited to the embodiments set forth herein for purposes of exemplification, but it is limited only by the scope of the attached claims, including the full range equivalency to which each element thereof is entitled.

What is claimed is:

1. An apparatus for truing out of round components of rotating mechanisms comprising abrasive means for engaging and removing high areas and imperfections from an outer surface of an out of round rotating component and holder means for holding said abrasive means against said outer surface, said abrasive means including a grindstone having an end with a cross-sectional area of a predetermined size, said holder means including sleeve means having a cross-sectional area of a larger predetermined size than the predetermined size of the cross-sectional area of said grindstone for telescopically receiving said grindstone therein, fastener means for securing said grindstone relative to said sleeve means such that a predetermined amount of said grindstone protrudes from an end of said sleeve means when said grindstone is ready for use, means for connecting a vacuum source to said sleeve means for drawing air therethrough and thereby removing debris created by the truing operation, and a predetermined amount of weight added to said sleeve means wherein a predetermined amount of weight of the apparatus is coordinated to said predetermined size of said cross-sectional area of said grindstone such that the apparatus has a predetermined amount of resistance to movement when said end of said grindstone is engaging the surface of the rotating component.

2. An apparatus as set forth in claim 1 wherein a nonconductive shell encompasses said sleeve means and said added weight, and said means for connecting includes an end of said shell being adapted for connection of the vacuum source thereto.

3. An apparatus as set forth in claim 2 wherein said sleeve means is generally rectangular and said vacuum source draws debris through said sleeve means below said grindstone.

4. An apparatus as set forth in claim 3 wherein said fastener means includes set screws for securing said grindstone such that said grindstone extends outwardly of said end of said rectangular sleeve less than 1.5 inches.

5. An apparatus as set forth in claim 4 wherein said rectangular sleeve includes reinforcing means for the end through which said grindstone extends and said set screws cooperate with said reinforcing means for securing said grindstone relative thereto.

6. An apparatus as set forth in claim 5 wherein said added weight includes lead weights molded to said rectangular sleeve, said lead weights conforming to an inside of said shell with the overall shape and size of the apparatus being adapted to be gripped by a user, said lead weights providing stability for said grindstone by causing a predetermined amount of resistance to movement when said apparatus is being used for truing out of round components of the rotating mechanism.

7. An apparatus as set forth in claim 4 wherein said grindstone is at least one quarter of an inch thick and said rectangular sleeve is generally at least twice as thick as said grindstone such that said vacuum source can draw said debris freely therethrough beneath said grindstone.

8. An apparatus as set forth in claim 7 wherein said grindstone includes abrasive between 120 grit and 220 grit.

9. An apparatus as set forth in claim 2 wherein said vacuum source includes flexible hose means permitting freedom of movement of the apparatus relative to said rotating component.

* * * * *